United States Patent [19]

Takeshita

[11] 4,061,119

[45] Dec. 6, 1977

[54] EXHAUST GAS RECIRCULATION APPARATUS FOR AN INTERNAL COMBUSTION ENGINE

[75] Inventor: Tomon Takeshita, Nagoya, Japan

[73] Assignee: Toyota Jidosha Kogyo Kabushiki Kaisha, Toyota, Japan

[21] Appl. No.: 707,339

[22] Filed: July 21, 1976

[30] Foreign Application Priority Data

Apr. 27, 1976 Japan ..... 51-47281

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 2,114,548 | 4/1938 | Stadlman | 123/119 A |
| 3,530,843 | 9/1970 | Fessenden | 123/119 A |
| 3,782,348 | 1/1974 | Linder | 123/119 A |
| 3,800,766 | 4/1974 | Schubeck | 123/119 A |
| 3,827,414 | 8/1974 | Sarto | 123/119 A |
| 3,868,934 | 3/1975 | Mick | 123/119 A |
| 3,906,909 | 9/1975 | Garcea | 123/119 A |
| 3,908,018 | 9/1975 | Tange et al. | 123/119 A |
| 3,954,091 | 5/1976 | Stumpp | 123/119 A |
| 3,980,063 | 9/1976 | Henault | 123/119 A |
| 3,998,194 | 12/1976 | Berzlapa | 123/119 A |

FOREIGN PATENT DOCUMENTS

| | | | |
|---|---|---|---|
| 2,521,681 | 11/1975 | Germany | 123/119 A |

*Primary Examiner*—Wendell E. Burns

*Attorney, Agent, or Firm*—Stevens, Davis, Miller & Mosher

[57] ABSTRACT

An exhaust gas recirculation apparatus for an internal combustion engine, in which the exhaust gas from the exhaust system of the engine is recirculated into the intake system of the engine in a position upstream of the throttle valve and in a position downstream of the throttle valve.

A sufficient amount of exhaust gas can be recirculated, without causing adverse effects to the heavy load operation of the engine.

5 Claims, 4 Drawing Figures

EXHAUST GAS RECIRCULATION APPARATUS FOR AN INTERNAL COMBUSTION ENGINE

FIELD OF THE INVENTION

The present invention relates to an exhaust gas recirculation (EGR) apparatus of an internal combustion engine, and particularly to such an EGR apparatus in which the exhaust gas is recirculated into the intake system of the engine in an EGR port located upstream of the throttle valve and in an EGR port located downstream of the throttle valve.

BACKGROUND OF THE INVENTION

Known EGR apparatuses are divided into two types. In the first type of EGR apparatus, the exhaust gas is recirculated into the intake system of the engine in a position located upstream of the throttle valve. In the second type of EGR apparatus, the exhaust gas is recirculated into the intake system in a position located downstream of the throttle valve. A characteristic of the first type EGR apparatus is that said EGR apparatus has a proportion of recirculated gas, i.e., the ratio of the amount of the exhaust gas being recirculated to the amount of the intake air to the engine, which is always constant irrespective of the degree of the throttle opening. On the other hand, the second type EGR apparatus has such a characteristic that the larger the throttle opening, the lower will be the recirculated gas proportion.

In these EGR apparatuses it is desired to recirculate a sufficient amount of EGR gas for reducing to a great extent the amount of nitrogen oxides ($NO_x$) emission, due to the strict regulations directed against exhaust gas pollution from engines which is undoubtedly a great public nuisance.

However, the above-mentioned first type EGR apparatus suffers from the following shortcoming. Since its proportion of recirculated gas remains constant during a progression from a light load operation (in which the throttle opening is small) to a heavy load operation (in which the throttle opening is large), if the proportion of EGR is increased during the light load operation, too much exhaust gas is recirculated during the heavy load operation, which causes adverse effects to the heavy load operation, for example, to the accelerating operation.

The above-mentioned second type EGR apparatus has the following shortcoming. Since its proportion of recirculated gas decreases from a light load operation to a heavy load operation, if said proportion is increased during the light load operation, too little exhaust gas can be recirculated during the heavy load operation; therefore, effective elimination of the $NO_x$ components during the heavy load operation cannot be expected.

SUMMARY OF THE INVENTION

An object of the invention is to provide an exhaust gas recirculation apparatus in which said first and second type EGR apparatuses are combined.

Another object of the present invention is to provide an exhaust gas recirculation apparatus in which a sufficient amount of exhaust gas is recirculated, without causing adverse effects to the heavy load operation of the engine.

According to the invention, an exhaust gas recirculation apparatus for an internal combustion engine is provided, which apparatus comprises:

a first means for recirculating the exhaust gas from the exhaust system of the engine to the intake system of the engine in a first position downstream of a throttle valve of the engine in accordance with a degree of the opening of said throttle valve, and;

a second means for recirculating the exhaust gas from said exhaust system to said intake system in a second position upstream of said throttle valve in accordance with the degree of the throttle opening. Therefore, a sufficient amount of exhaust gas can be recirculated during a light and a medium load operation of the engine to reduce the amount of $NO_x$ emission in said operation; whereas, a large amount of exhaust gas is recirculated during a heavy load operation of the engine to prevent adverse effects to said heavy load operation due to an excessive amount of the recirculated exhaust gas.

DESCRIPTION OF THE PREFERRED EMBODIMENTS

Figure 1:
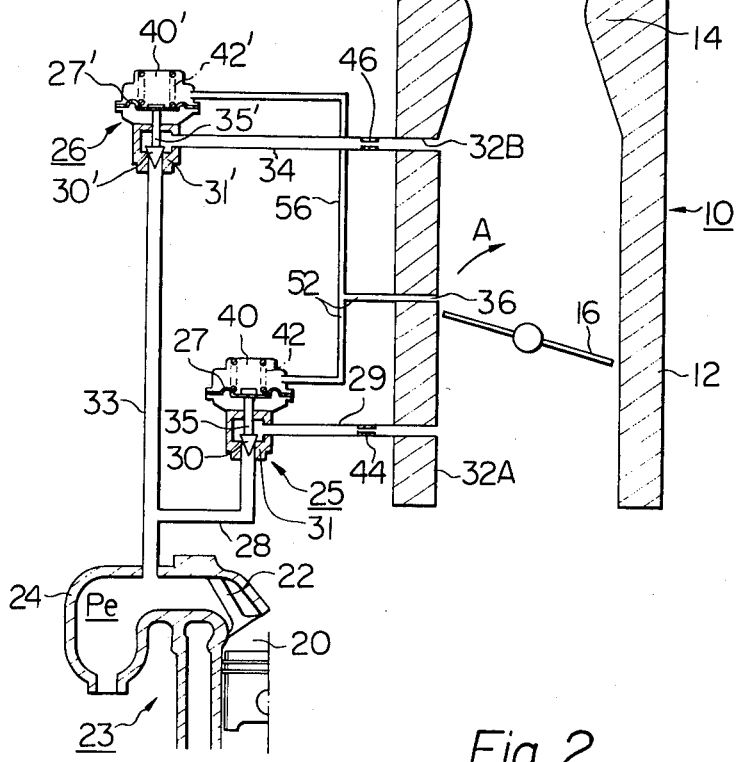
FIG. 1 is a schematic diagram showing an EGR apparatus according to the embodiment of the present invention.

In FIG. 1 showing a first embodiment of the present invention, numeral 10 designates a carburetor having barrel 12 provided with a venturi 14 and a throttle valve 16. The carburetor 10 is connected to an air cleaner (not shown) arranged upstream of the venturi 14, and is connected to combustion chambers 20 (only one of which is shown) in an engine body 23, via an intake manifold (not shown) arranged downstream of the carburetor 10.

According to the invention, an exhaust manifold 24, which is connected to the combustion chamber 20 via an exhaust valve 22, is connected to a first port $32_A$ in the carburetor 10 in a position downstream of the throttle valve 16 via a first exhaust gas recirculation valve (EGR valve) 25 arranged between a tube 28 connected to the exhaust manifold 24 and a tube 29 connected to the carburetor 10 in said port $32_A$, and is connected to a second port $32_B$ in the carburetor 10 in a position upstream of the throttle valve 16 via a second EGR valve 26 arranged between a tube 33 connected to the tube 28 and a tube 34 connected to the carburetor 10 in said second port $32_B$. The EGR valve 25 is of a known diaphragm control type, including a rod 35, a valve seat 31, a valve member 30 on one end of the rod 35, a diaphragm 27 to form a control chamber 40 on one side of the diaphragm 27 and a spring 42 urging the diaphragm 27 and the valve member 30 toward the valve seat 31. The EGR valve 25 is in a closed condition when the control chamber 40, which is connected to a vacuum signal port 36 located slightly above the closed throttle valve 16 via a signal tube 52, has an atmospheric pressure whereby the valve member 30 closes the valve seat 31 under a force caused by the spring 42 and thereby interrupting communication between the tubes 28 and 29 for stopping the EGR operation. The EGR valve 25 is, on the other hand, in an opened condition when the control chamber 40 has such a vacuum pressure whereby the diaphragm 27 is displaced upwardly against the force caused by the spring 42 so as to allow the valve member 30 to be detached from the seat 31, so that communication between the tubes 28 and 29 is attained for recirculating a part of the exhaust gas from the exhaust manifold 24 to the first EGR port $32_A$ through the tubes 28 and 29. The amount of the recirculated gas is controlled by an orifice 44 arranged in the tube 29.

The construction of the second EGR valve 26 is substantially the same as that of the valve 25, which valve 26 is of a known diaphragm control type, including a rod 35', a valve seat 31', a valve member 30' located on one end of the rod 35', a diaphragm 27' to form a control chamber 40' on one side of the diaphragm 27' and a spring 42'. The EGR valve 26 is in a closed condition for stopping the EGR operation, when the control chamber 40', which is connected to the signal tube 52 through another signal tube 56, has such an atmospheric pressure whereby the valve member 30' closes the seat 31' under a force caused by the spring. The valve 26, on the other hand, is in an opened condition when the control chamber 40' is at a vacuum pressure for recirculating a part of the exhaust gas from the exhaust manifold 24 to the second EGR port $32_B$ through the tubes 33 and 34. The amount of the recirculated gas from the EGR port $32_B$ is controlled by an orifice 46 arranged in the tube 34.

The operation of the embodiment illustrated in FIG. 1 will be explained hereinbelow.

When the engine is in an idle operation during which the throttle valve 16 is completely closed as shown in FIG. 1, the control chambers 40 and 40' of the respective EGR valves 25 and 26 are opened, through the tubes 52 and 56, to the signal port 36 located above the closed throttle valve 16. Therefore, the chambers 40 and 40' are at atmospheric pressure, and thus the diaphragms 27 and 27' are subjected to the initial set force of the springs 42 and 42', which force causes the valve members 30 and 30' to close the respective valve seats 31 and 31', thereby preventing the EGR operation from being carried out.

When the throttle valve 16 is rotated for starting a vehicle as shown in an arrow A, the chambers 40 and 40' are opened, through the signal tubes 52 and 56, to the signal port 36 which is now located downstream of the opened throttle valve 16. Therefore, a vacuum signal is transmitted to the chambers 40 and 40' from the signal port 36 through the respective signal tubes 52 and 56, and thus the diaphragms 27 and 27' are displaced upwardly against the force of the respective springs 42 and 42', so that the valve members 30 and 30' are detached from the respective valve seats 31 and 31'. Thus the exhaust gas from the exhaust manifold 24 is recirculated to the carburetor 10 in both EGR ports $32_A$ and $32_B$, through the respective EGR valves 25 and 26.

Figure 2:
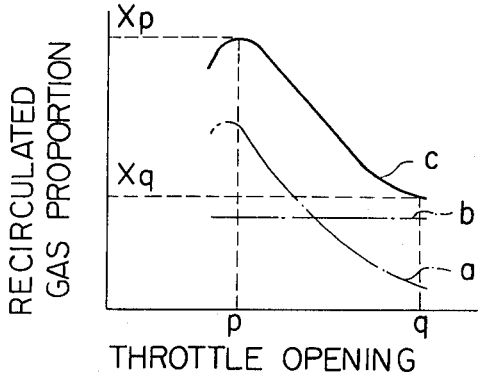
FIG. 2 is a graph showing the proportion of recirculated gas versus the throttle opening.

A curve *a* in FIG. 2 characterizes the first EGR valve 25, in which the degree of opening of the throttle valve 16 versus the proportion of recirculated gas in the first EGR port $32_A$ (i.e., the ratio of the amount of exhaust gas recirculated through the first EGR port $32_A$ to the amount of intake air in the engine) is shown. As is clear from the curve *a*, the smaller the throttle opening, the higher is the proportion of recirculated gas. Another curve *b* in FIG. 2 characterizes the second EGR valve 26, in which a degree of the opening of the throttle valve 16 versus the proportion of recirculated gas in the second EGR port $32_B$ is shown. As shown by the curve *b*, the proportion of circulated gas remains always constant irrespective of the degree of throttle opening.

In the present invention, since the exhaust gas is recirculated through both of the first and second EGR ports $32_A$ and $32_B$, the total proportion of recirculated gas versus the degree of throttle opening is shown as a curve *c* which is a combination of the curves *a* and *b*. According to the invention, as shown by the curve *c*, a large proportion $X_p$ of recirculated gas is obtained when the engine is in a light and a medium load operation in which the throttle opening is as small as *p*. Therefore, a sufficient amount of exhaust gas can be recirculated during a light and a medium load operation for reducing the amount of $NO_x$ emission to a great extent. On the other hand, a proportion $X_q$ of recirculated gas present when the engine is in a heavy load operation during which the throttle opening is as large as *q*, can be so selected that a maximum amount of exhaust gas can be recirculated without causing adverse effects to the heavy load operation due to the EGR operation. Thus it is possible to provide such an EGR apparatus in which a sufficient amount of exhaust gas can be recirculated to reduce the $NO_x$ emission, without causing adverse effects to the heavy load operation.

The shape of curve *c* is determined by both the shapes of curves *a* and *b*, in other words, by the dimensions of the orifices 44 and 46. Therefore, it is necessary to adjust these dimensions so as to obtain the desired shape of curve *c*.

Figure 3:
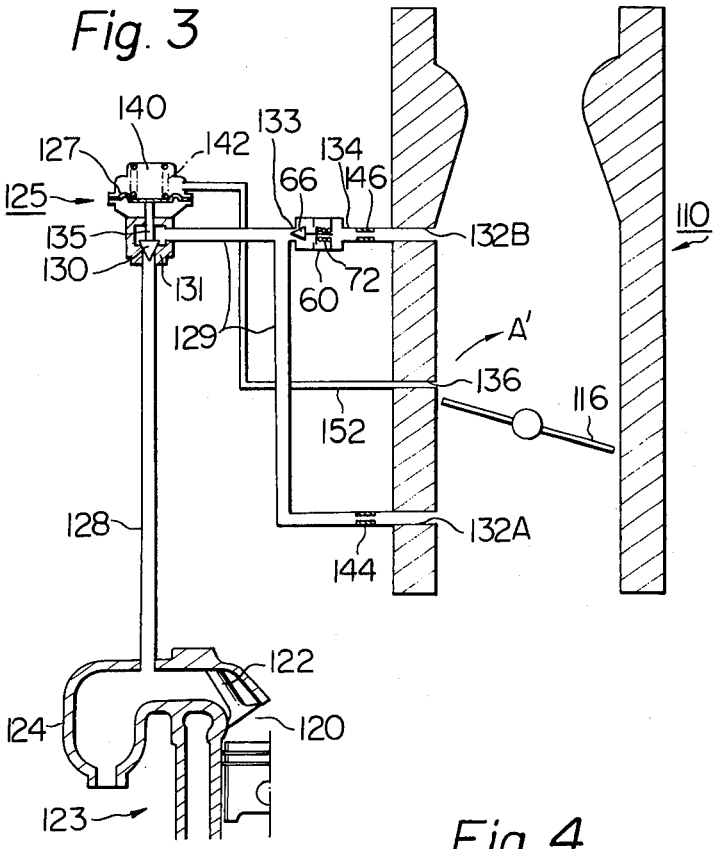
FIG. 3 is a schematic diagram showing another embodiment of the present invention.

In another embodiment shown in FIG. 3, only one EGR valve 125 is used to connect an exhaust manifold 124 with a carburetor 110 in a first EGR port $132_A$ located downstream of a throttle valve 116, and in a second EGR port $132_B$ located upstream of the throttle valve 116. The EGR valve 125 has substantially the same construction as that of the valve 25 and 26 in FIG. 1, which valve 125 comprises a rod 135, a valve member 130 a valve seat 131, a diaphragm 127 to form a vacuum chamber 140 on one side of the diaphragm 127 and a spring 142. The EGR valve 125 is in a closed condition when the vacuum chamber 140 has an atmospheric pressure in which the valve member 130 closes the valve seat 131 for stopping the EGR operation. The EGR valve 125 is in an opened condition when the vacuum chamber 140 has a vacuum pressure, in which the diaphragm 127 is displaced upwardly against the spring 142, thus allowing the valve member 130 to be opened from the valve seat 131, so that a part of the exhaust gas in the exhaust manifold 124 is recirculated, through tubes 128 and 129, into the first EGR port $132_A$. The amount of the recirculated gas through the first EGR port $132_A$ is controlled by an orifice 144 arranged in the tube 129.

In place of the EGR valve 26 in FIG. 1, the second embodiment in FIG. 3, has a check valve 60 arranged between a tube 133 connected to the tube 129 and a tube 134 connected to a second EGR port $132_B$ in the carburetor 110 in a position upstream of the throttle valve 116. The check valve 60 is adapted for passing the exhaust gas from the EGR valve 125 to the second EGR port $132_B$ through an orifice 146 in the tube 134 while preventing communication of exhaust gas between the second EGR port $132_B$ and the first EGR port $132_A$ when the engine is in an idle operation during which no EGR operation is being carried out.

Figure 4:
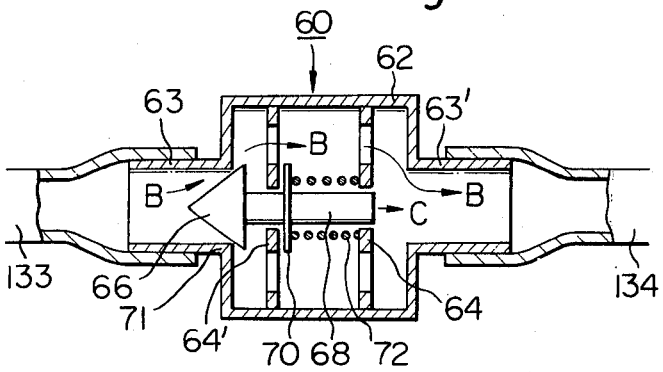
FIG. 4 is a sectional view showing a check valve in the apparatus shown in FIG. 3.

As shown in FIG. 4, the check valve 60 comprises a casing 62 having an inlet 63 and an outlet 63'. Two perforated plates 64 and 64' are arranged across the interior of the casing 62 in a parallel relation. A valve member 66 of a conical shape, provided with a stem portion 68 is arranged in the casing 62 so that the stem portion 68 can be inserted into the center holes of the plates 64 and 64'. A spring 72 is arranged between the plate 64 and a flange 70 formed on the stem portion 68, for urging the valve member 66 toward a valve seat 71. The inlet 63 is connected to one end of the tube 133, and the outlet 63' is connected to one end of the tube 134 (FIG. 3).

The operation of the second embodiment illustrated in FIGS. 3 and 4 will be explained hereinafter.

When the engine is in an idle operation during which the throttle valve 116 is completely closed as shown in FIG. 3, the vacuum chamber 140 of the EGR valve 125 is opened, through a signal tube 152, to a signal port 136 located sligtly above the closed throttle valve 116. Therefore, the vacuum chamber 140 is at an atmospheric pressure whereby the valve member 130 closes the valve seat 131 under a force caused by [an initial set of ] the spring 142, thereby preventing the EGR operation from being carried out. In this idle operation, the spring 72 (FIG. 4) of the check valve 60 urges the valve member 66 so that said valve member is rested upon the valve seat 71, thereby preventing communication between the first EGR port $132_A$ (FIG. 3) and the second EGR port $132_B$ (FIG. 3). Therefore, the air in the second EGR port $132_B$ located above the throttle valve 116 cannot pass to the first EGR port $132_A$ located downstream of the throttle valve 116, so that a constant ratio of the air fuel supplied to the combustion chamber 120 during the idle operation is maintained for stabilizing the idle operation.

When the throttle valve 116 is rotated for starting the vehicle as shown by an arrow A', the vacuum chamber 140 is opened through the signal tube 152, to the signal port 136 located downstream of the opened throttle valve 116. Therefore, a vacuum signal in the carburetor 110 downstream of the throttle valve 116 is transmitted to the vacuum chamber 140, and thus the diaphragm 127 is displaced upwardly against the force of the spring 142, which causes the valve member 130 to be detached from the valve seat 131, so that the exhaust gas from the exhaust manifold 124 is recirculated into the carburetor 110 in the first EGR port $132_A$, through the tubes 128 and 129. In this case, the exhaust gas from the EGR valve 125 is also recirculated into the carburetor 110 in a second EGR port $132_B$, because the valve member 66 is of the check valve 60 is displaced against the force of the spring 72 (FIG. 4) in the direction of an arrow C (FIG. 4) due to the pressure of the exhaust gas being recirculated, during which the exhaust gas from the tube 133 is passed through the check valve 60 to the tube 134 as shown by arrow C.

In this operation of the second embodiment, since the exhaust gas is recirculated into the intake system in both the first and second EGR ports $132_A$ and $132_B$, the same curve *c* as shown in FIG. 2 is obtained by adjusting the dimensions of the orifices 144 and 146. Therefore, a sufficient amount of exhaust gas can be recirculated for reducing the $NO_x$ emission to a great extent, without adversely affecting the heavy load operation.

Additional modifications and improvements can be made by those skilled in this art; said modifications and improvements are included within the scope of the invention as defined by the appended claims.

What is claimed is:

1. An exhaust gas recirculation apparatus comprising conduit means connecting the exhaust system of an engine to the intake system thereof at a first location downstream of the throttle valve of the engine and a second location upstream of said throttle valve, normally closed valve means in said conduit means to control flow from said exhaust system to said first and second locations, at least one of said valve means having a closed chamber with a diaphragm therein normally resiliently biasing a valve part to closed position and means to connect said closed chamber to a port located slightly above the fully closed position of said throttle valve whereby vacuum from said port may cause said diaphragm to move said valve part to opening position against said resilient bias and means to cause an effect of said vacuum to open the other of said valve means.

2. An exhaust gas recirculation apparatus for an internal combustion engine, comprising:

a first conduit for recirculating the exhaust gas from the exhaust system of the engine to the intake system of the engine in a first location downstream of a throttle valve of the engine, a first valve in said first conduit, said valve having a spring biased vacuum responsive diaphragm to control it, means connecting said diaphragm to a vacuum port located slightly above the fully closed position of said throttle valve, and;

a second conduit for recirculating the exhaust gas from said exhaust system to said intake system to a second location upstream of said throttle valve, a second valve in said second conduit, said second valve having a spring biased vacuum responsive diaphragm to control it, means connecting said diaphragm of said second valve to said vacuum port whereby exhaust gas of a sufficient amount can be recirculated during a light and a medium load operation of the engine to reduce the amount of $NO_x$ emission from the engine, whereas exhaust gas of a minimum amount can be recirculated during a heavy load operation to prevent adverse effects to said heavy load operation.

3. An exhaust gas recirculation apparatus according to claim 2, further comprising:

a first flow control orifice arranged in said first conduit located downstream of the first diaphragm control valve, and;

a second flow control orifice arranged in said second conduit located downstream of the second diaphragm control valve, whereby a predetermined shape of a characteristic curve showing the proportion of recirculated gas versus the degree of throttle opening is possible by adjusting the dimensions of said first and second orifices.

4. An exhaust gas recirculation apparatus for an internal combustion engine, comprising:

a first conduit for recirculating the exhaust gas from the exhaust system of the engine to the intake system of the engine in a first location downstream of a throttle valve of the engine, a diaphragm control valve in said first conduit, means connecting said valve to a vacuum port located slightly above the fully closed position of said throttle valve, and;

a second conduit downstream of said diaphragm control valve for recirculating exhaust gas from said exhaust system to a second position of said intake system upstream of said throttle valve, a check valve located in said second conduit which is opened by the recirculating exhaust gas when said diaphragm valve is open.

5. An exhaust gas recirculation apparatus according to claim 4, further comprising:

a first flow control orifice arranged in said first conduit located downstream of the first diaphragm control valve, and;

a second flow control orifice arranged in said second conduit located downstream of said check valve whereby a predetermined shape of a characteristic curve showing the proportion of recirculated gas versus the degree of throttle opening is obtained by adjusting the dimensions of said first and second orifices.

* * * * *